US009951537B2

(12) United States Patent
Osuna et al.

(10) Patent No.: US 9,951,537 B2
(45) Date of Patent: Apr. 24, 2018

(54) TOP-BOTTOM POOL CLEANER INCLUDING A NOSE

(71) Applicant: Hayward Industries, Inc., Elizabeth, NJ (US)

(72) Inventors: Omar Enrique Osuna, Clemmons, NC (US); Joseph Tessitore, Clemmons, NC (US)

(73) Assignee: Hayward Industries, Inc., Elizabeth, NJ (US)

( * ) Notice: Subject to any disclaimer, the term of this patent is extended or adjusted under 35 U.S.C. 154(b) by 0 days.

(21) Appl. No.: 15/183,961

(22) Filed: Jun. 16, 2016

(65) Prior Publication Data

US 2017/0362844 A1 Dec. 21, 2017

(51) Int. Cl.
*E04H 4/16* (2006.01)
*E04H 4/12* (2006.01)

(52) U.S. Cl.
CPC ..... *E04H 4/1654* (2013.01); *E04H 4/1263* (2013.01)

(58) Field of Classification Search
CPC ..... E04H 4/1654; E04H 4/1263
USPC .... 210/167.16, 167.17, 416.1, 416.2, 167.15
See application file for complete search history.

(56) References Cited

U.S. PATENT DOCUMENTS 4,338,697 A * 7/1982 Broadwater ..... E04H 4/1609 15/1.7
2001/0032809 A1* 10/2001 Henkin ..... E04H 4/1654 210/143
2016/0060887 A1* 3/2016 Tryber ..... E04H 4/1654 15/1.7

* cited by examiner

*Primary Examiner* — Fred Prince
(74) *Attorney, Agent, or Firm* — McCarter & English, LLP

(57) ABSTRACT

A top-bottom pool cleaner is provided including a top housing and a nose attached to the top housing. The top housing including an exterior surface and a top surface having a filter. The nose defines a chamber for receiving and retaining water within the nose. The chamber of the nose receives water through the filter when the cleaner is submerged and retains water within the chamber when the cleaner reaches a top surface of the water from under the water surface, the retention of the water within the nose preventing the pool cleaner from oscillating above and below the top surface of the water.

20 Claims, 8 Drawing Sheets

TOP-BOTTOM POOL CLEANER INCLUDING A NOSE

BACKGROUND OF THE INVENTION

Field of the Invention

The present invention relates to a top-bottom swimming pool pressure cleaner, and, more specifically to a top-bottom swimming pool pressure cleaner including a nose.

Related Art

Swimming pools generally require a certain amount of maintenance. Beyond the treatment and filtration of pool water, the walls of the pool should be scrubbed regularly. Further, leaves and various debris can float on the surface of the pool water, and should be removed regularly. Swimming pool cleaners adapted to rise proximate a water surface of a pool for removing floating debris therefrom and to descend proximate to a wall surface of the pool for removing debris therefrom are generally known in the art. These "top-bottom" cleaners are often pressure-type or positive pressure pool cleaners that have a source of pressurized water in communication therewith. This source of pressurized water could include a booster pump, for example. Generally, this involves a hose running from the pump to the cleaner head. However, when the top-bottom pool cleaner reaches the water surface, the cleaner may oscillate vertically above and below the water surface impacting the effectiveness of the pool cleaner to adequately clean debris from the surface of the water. Another issue with top-bottom pool cleaners is that a pressure wave located in the front of the pool cleaner can direct debris away from the cleaner. For example, as shown in FIG. 12, a prior art pool cleaner is shown to create a pressure wave 8 that directs debris along lines A, away from the pool cleaner.

Accordingly, there is a need for improvements in top-bottom pool cleaners that are capable of dampening the oscillation of the pool cleaner at the water surface, directing debris into the pool cleaner rather than away from it, and/or providing other advantages.

SUMMARY OF THE INVENTION

A top-bottom pool cleaner is provided including a top housing and a nose attached to the top housing. The top housing including an exterior surface and a top surface having a filter. The nose defines a chamber for receiving and retaining water within the nose. The chamber of the nose receives water through the filter when the cleaner is submerged and retains water within the chamber when the cleaner reaches a top surface of the water from under the water surface, the retention of the water within the nose preventing the pool cleaner from oscillating above and below the top surface of the water.

BRIEF DESCRIPTION OF THE DRAWINGS

The foregoing features of the invention will be apparent from the following Detailed Description of the Invention, taken in connection with the accompanying drawings, in which.

DETAILED DESCRIPTION OF THE INVENTION

Figure 10:
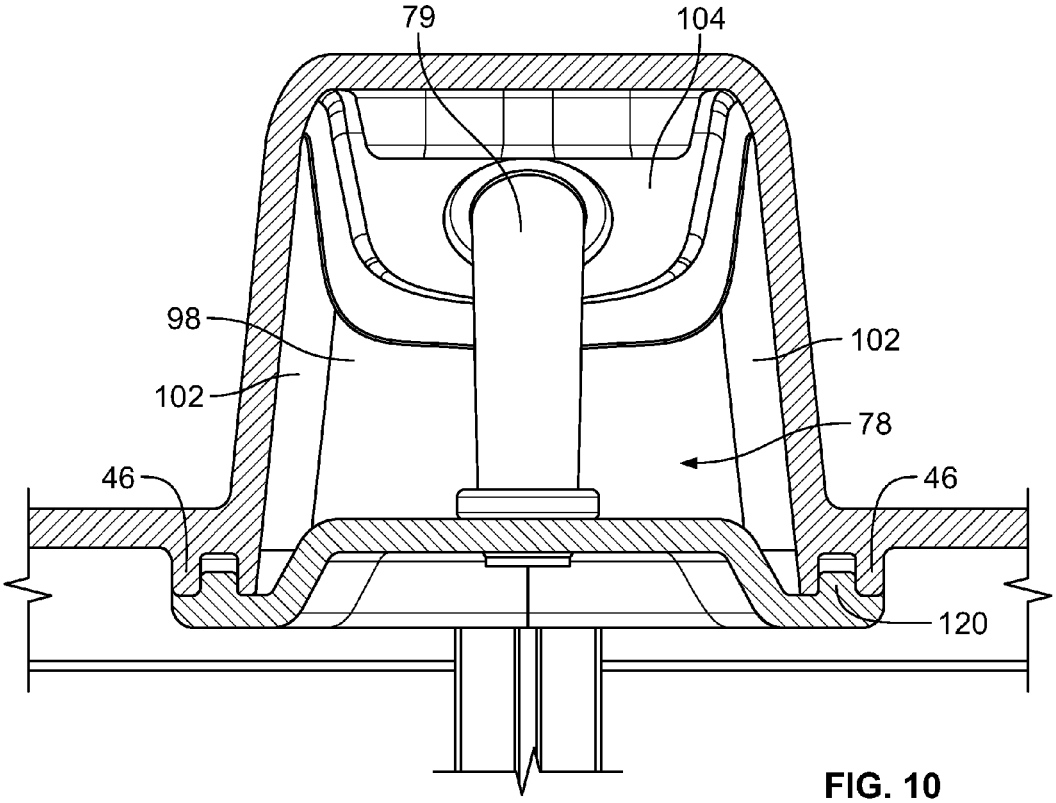
FIG. 10 is a cross-sectional view of the nose of the pool cleaner of the present disclosure taken along line 10-10 of FIG. 6.
Figure 11:
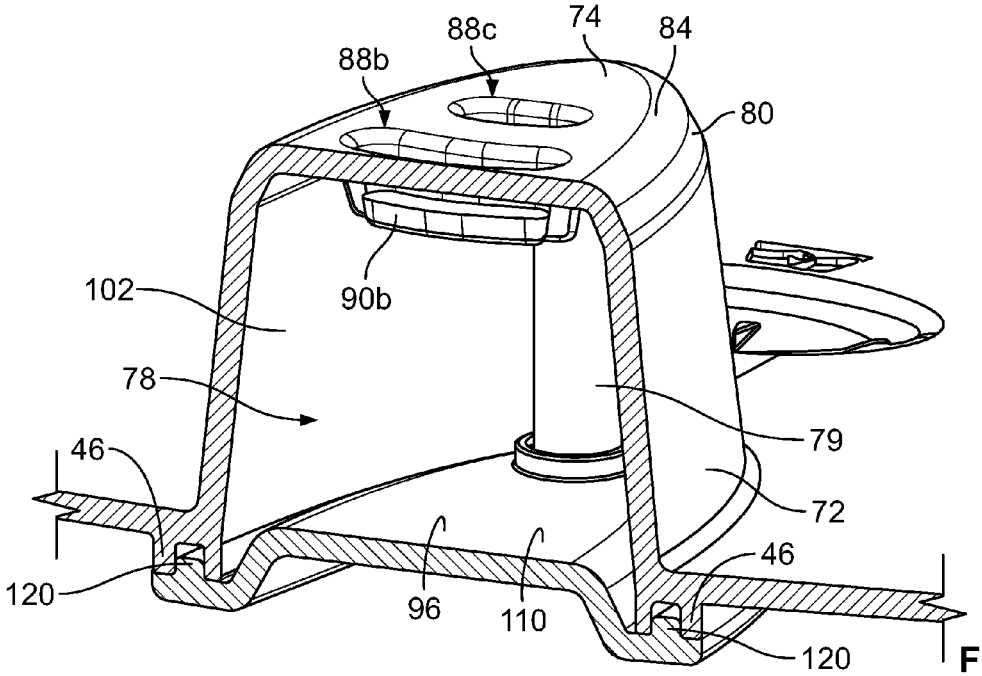
FIG. 11 is a cross-sectional view of the nose of the pool cleaner of the present disclosure taken along line 11-11 of FIG. 6.
Figure 12:
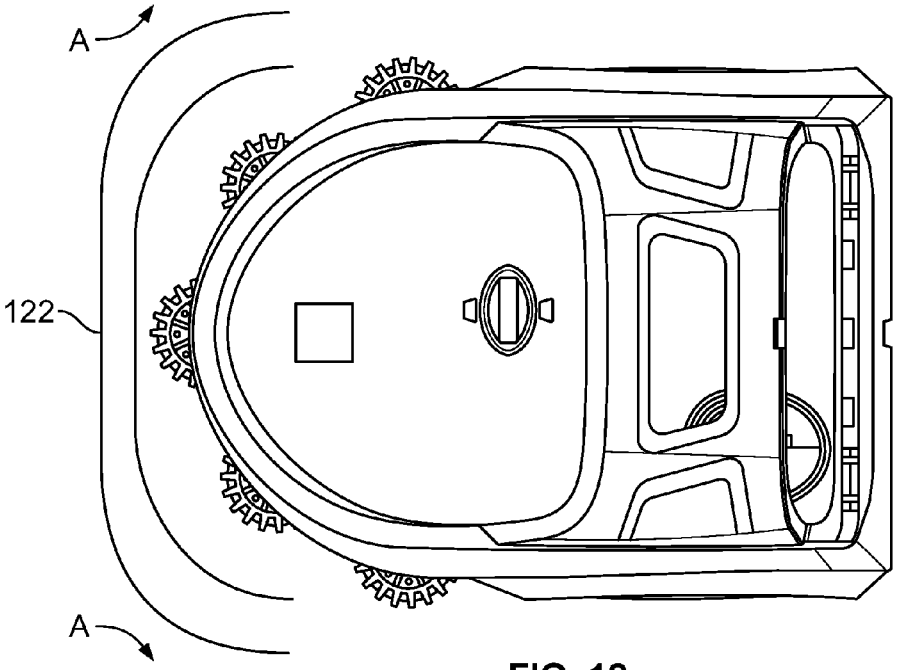
FIG. 12 (Prior Art)
FIG. 12 is a top view of a prior art design of a pool cleaner.

The present invention relates to a positive pressure top/bottom pool cleaner, as discussed in detail below in connection with FIGS. 1-13, of which FIGS. 1-11 and 13 are views of the pool cleaner of the present disclosure and of which FIG. 12 is prior art.

Figure 1:
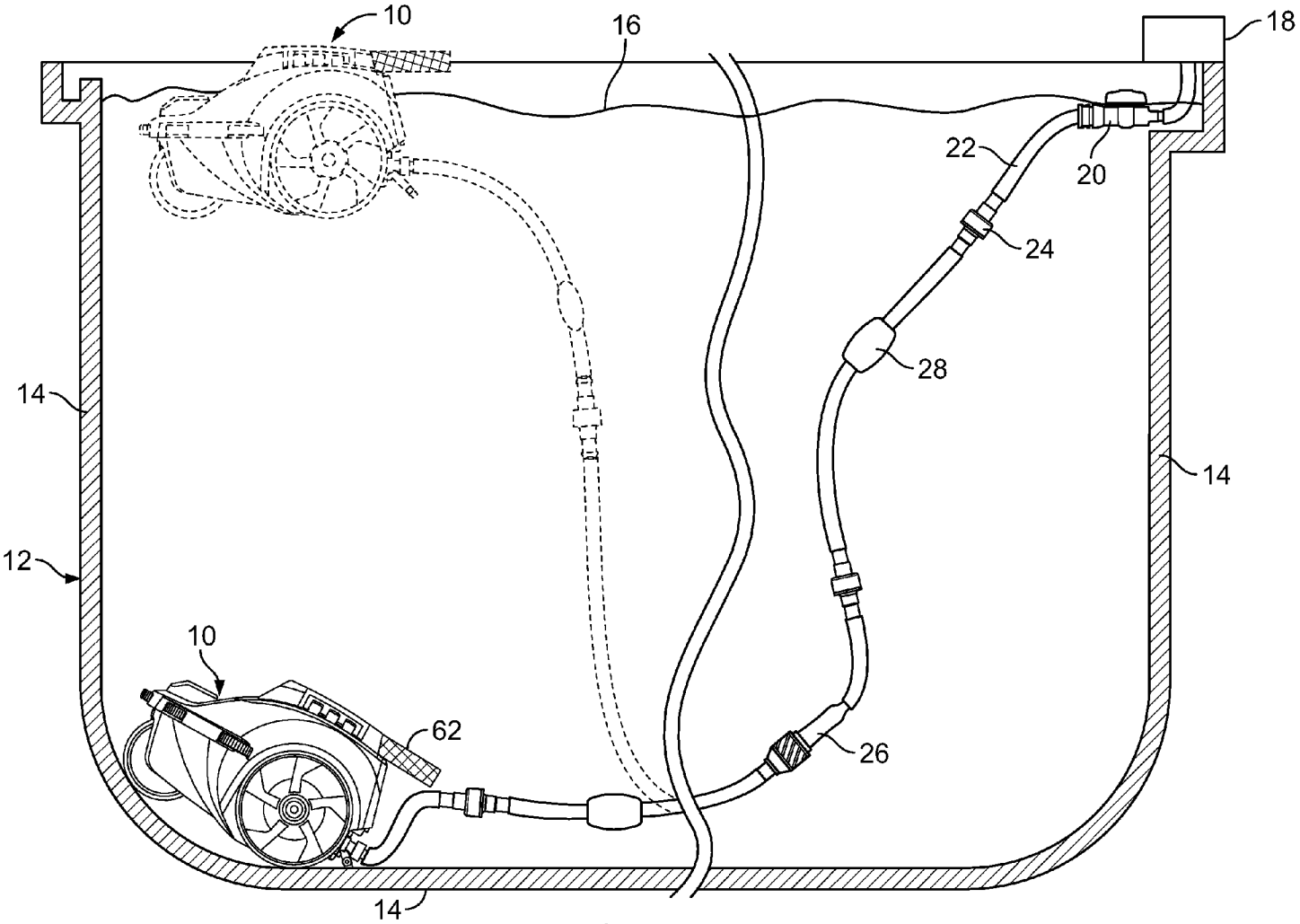
FIG. 1 is a schematic representation of a top-bottom pressure pool cleaner of the present disclosure in a pool.

Referring initially to FIG. 1, a top-bottom pressure pool cleaner 10 of the present disclosure is shown operating in a swimming pool 12. The cleaner 10 is configured to switch between two cleaning modes, a bottom cleaning mode and a top/skim cleaning mode. When the cleaner 10 is in the bottom mode, it will traverse the pool walls 14, including side walls and bottom floor wall, cleaning them to remove debris. When the cleaner 10 is in the top mode, it travels across and skims the pool water line 16, trapping any floating debris proximate the pool water line 16.

As shown in FIG. 1, the pool cleaner 10 is connected to an external booster pump 18 by a hose connection 20 and a segmented hose 22. The segmented hose 22 is connected to a rear inlet of the pool cleaner 10 and extends to the hose connection 20, which is connected to the external pump 18. This connection allows the external pump 18 to provide pressurized water to the pool cleaner 10 to both power locomotion of the cleaner 10 as well as the cleaning capabilities of the cleaner 10. The segmented hose 22 may include one or more swivels 24, one or more filters 26, and one or more floats 28 installed in-line with the segmented hose 22. As such, the pressurized water flowing through the segmented hose 22 can also flow through the one or more swivels 24, one or more filters 26. The swivel 24 allows the segmented hose 22 to rotate at the swivel 24 without detaching the cleaner 10 from the external booster pump 18. As such, when the cleaner 10 travels about the pool 12, the segmented hose 22 will rotate at the one or more swivels 24, thus preventing entanglement. The one or more filters 26 may provide a filtering functionality for the pressurized water being provided to the cleaner 10.

Figure 2:
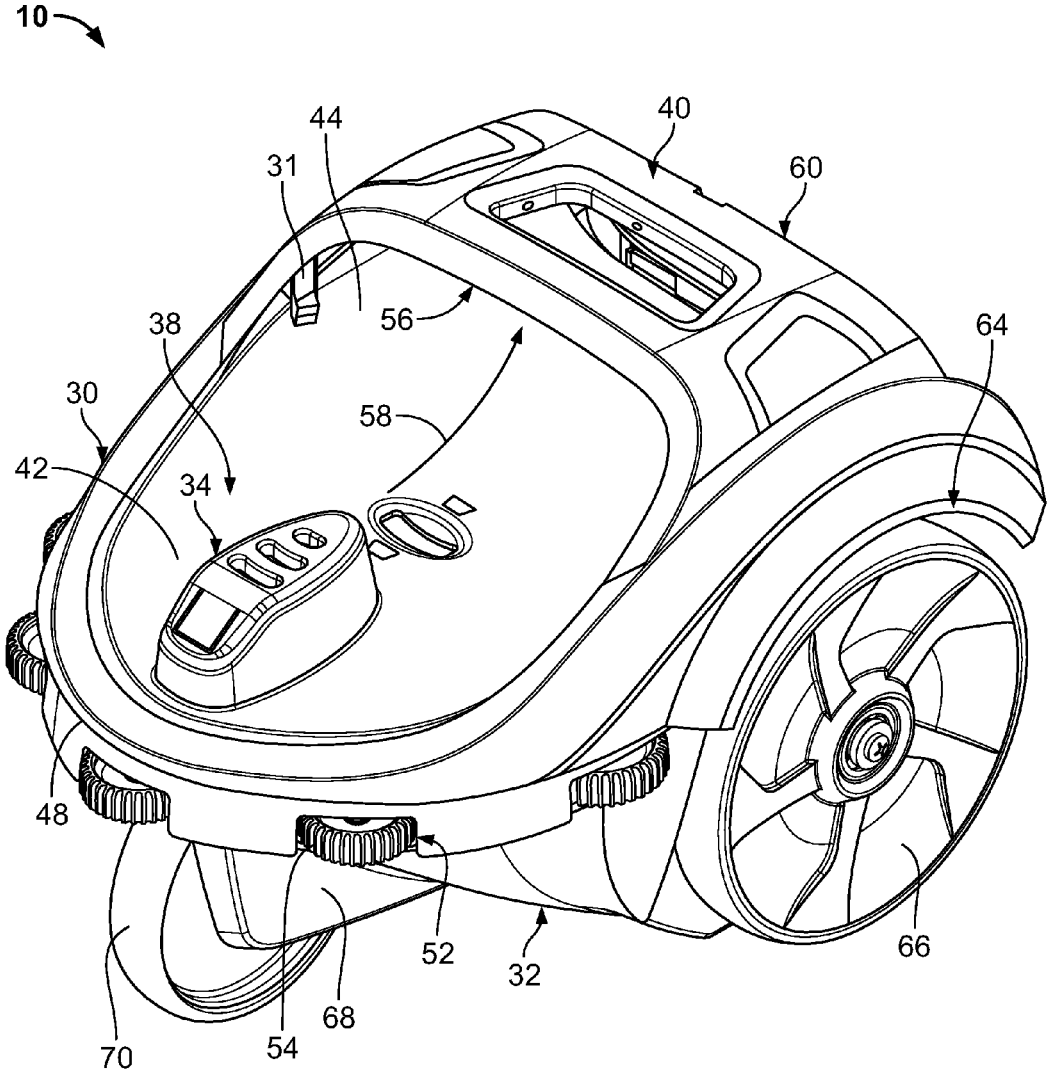
FIG. 2 is a perspective view of the pool cleaner of the present disclosure.
Figure 8:
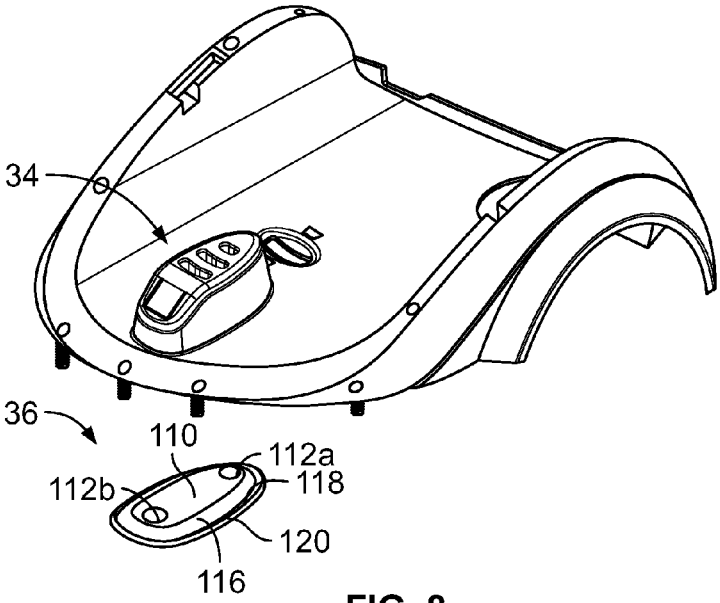
FIG. 8 is a partial exploded view of the pool cleaner of the present disclosure.

With reference to FIG. 2, the cleaner 10 includes a top housing 30, a plurality of skimmer/debris retention jets 31, a chassis 32, a nose 34 and a nose cover plate 36 (FIG. 8).

The top housing 30 includes a body 38 and a cross member 40. The body 38 includes a deck 42, sidewalls 44 extending generally upward from the deck 42, a nose cover protrusion 46 (FIG. 10), and a rounded front wall 48. The rounded front wall 48 includes a plurality of openings 52 adapted for a plurality of diverter wheels 54 to extend therethrough and past the rounded front wall 48. The plurality of diverter wheels 54 are rotatably mounted to the rounded front wall 48 such that the diverter wheels 54 extend through openings 52. The diverter wheels 54 function as rotatable bumpers so if the cleaner 10 approaches a pool wall 14, the diverter wheels 54 contact the pool wall 14 instead of the top housing 30 or the chassis 32. When in contact with the pool wall 14, the diverter wheels 54 rotate, allowing the cleaner 10 to be continually driven and moved along, and/or diverted away from the pool wall 14. Thus, the diverter wheels 54 protect the cleaner 10 from damage due to contact with the pool wall 14. Vice versa, the wheels 54 protect the pool walls 14 from damage due to the cleaner 10, e.g., scuffing, scratching, etc.

The cross member 40 connects to and spans across sidewalls of the body 38, forming a skimmer opening 56, a channel 58, and a rear opening 60. The skimmer opening 56 is an opening generally at the front of the cleaner 10 formed between the body 38 and the cross member 40 such that the skimmer opening 56 allows the flow of liquid and debris between the body 38 and the cross member 40, along the channel 58, and exiting the rear opening 60. The deck 42, the sidewalls 44, and the cross member 40 provide the structure that forms the channel 58. In operation, when the cleaner 10 is in "top" mode, debris that floats along the water line 16 of the pool 12 would travel through the skimmer opening 56, across the channel 58, e.g., along the deck 42, and out through the rear opening 60 into the debris bag 62 (FIG. 1).

A plurality of skimmer/debris retention jets 31 are positioned on each of the sidewalls 44 of the top housing body 38 to spray pressurized water rearward toward the debris bag 62. The skimmer/debris retention jets 31 spray pressurized water when the cleaner 10 is in the skim/top mode of operation. The skimmer/debris retention jets 31 function to force water and any debris that may be in the channel 58 rearward into the debris bag 62. Furthermore, the jetting of water rearward causes a venturi-like effect causing water that is more forward than the skimmer/debris retention jets 31 to be pulled rearward into the debris bag 62. Thus, the skimmer/debris retention jets 31 perform a skimming operation whereby debris is pulled and forced into the debris bag 62. Furthermore, the skimmer/debris retention jets 31 prevent debris that is in the debris bag 62 from exiting.

The chassis 32 includes wheel wells 64, which functions as side walls of the chassis 32 and a housing for the rear wheels 66. The rear wheels 66 are each respectively rotationally mounted to the wheel wells 64. The chassis 32 also includes a front wheel housing 68, which extends outwardly from the front of the chassis 32 and functions to rotationally secure a front wheel 70 to the chassis 32. The front wheel 70, and the rear wheels 66, which are freely rotatable, support the cleaner 10 on the pool walls 14 and allow the cleaner 10 to traverse the pool walls 14.

Figure 3:
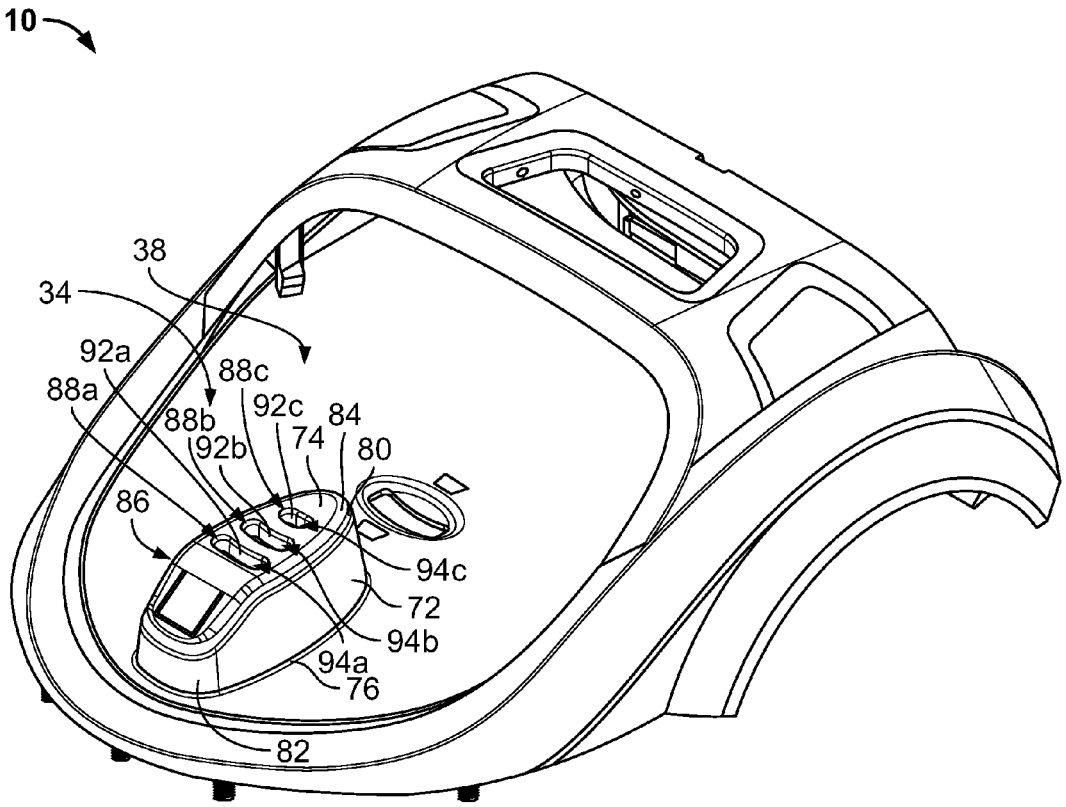
FIG. 3 is a perspective view of a top housing of the pool cleaner of the present disclosure.

Turning now to FIG. 3, the nose 34 includes an exterior surface 72, a top surface 74 and a bottom edge 76. The nose 34 also includes a nose water chamber 78 and a screw boss 79 (FIG. 11). Exterior surface 72 extends upward from the bottom edge 76, which is formed with the body 38. The bottom edge 76 of the nose 34 can be formed with the top housing body 38 in any suitable fashion known in the art, such as with mechanical fasteners or molding/bonding techniques. The exterior surface 72 includes a chamfered exterior edge 80 and a front exterior surface 82. The exterior surface 72 extends to the top surface 74, which together forms the water nose chamber 78, which will be discussed in greater detail below.

The top surface 74 includes a chamfered top edge 84, a sloped top portion 86, and a plurality of filters 88. The chamfered top edge 84 and chamfered exterior edge 80 both extend in an annular fashion around the nose 34. The chamfered top edge 84 directly abuts chamfered exterior edge 80 to provide a continuous surface between the exterior surface 72 and the top surface 74. The sloped top portion 86 extends downward from top surface 74. The chamfered top edge 84 and the chamfered exterior edge 80 similarly extend downward in the same sloped incline as the sloped top portion 86. The front exterior portion 82 extends upward from the top housing body 38 to the chamfered exterior edge 80 proximate to the sloped top portion 86. As a result, the front exterior portion 82 has a smaller height than the exterior surface 72. The sloped top portion 86 allows debris to pass over the nose 34 into the skimmer opening 56 through the channel 58 and into the debris bag 62. The sloped top portion 86 prevents the debris from getting stuck at the front exterior portion 82. It should be noted that the nose 34 can be shaped in any fashion known to those of ordinary skill in the art and the present application is not limited to the particular shapes described herein.

Figure 4:
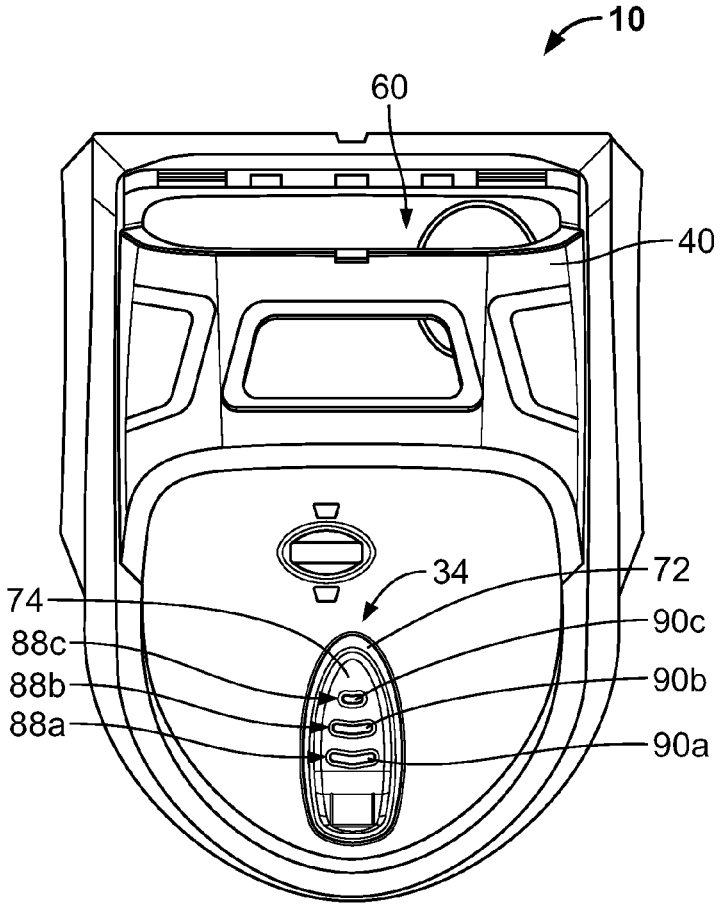
FIG. 4 is a top view of the top housing of the pool cleaner of the present disclosure.
Figure 5:
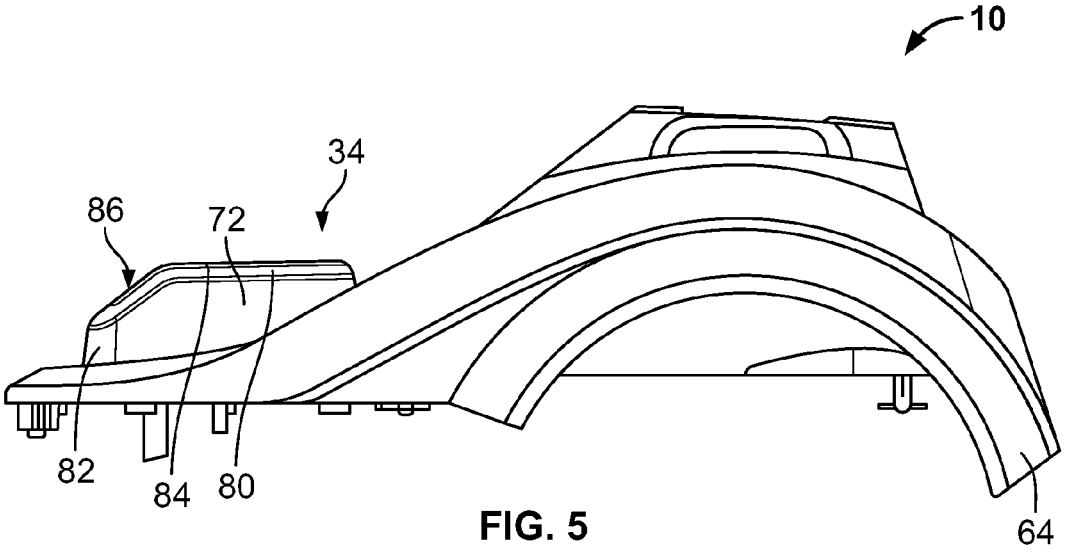
FIG. 5 is a left side view of the top housing of the pool cleaner of the present disclosure.
Figure 6:
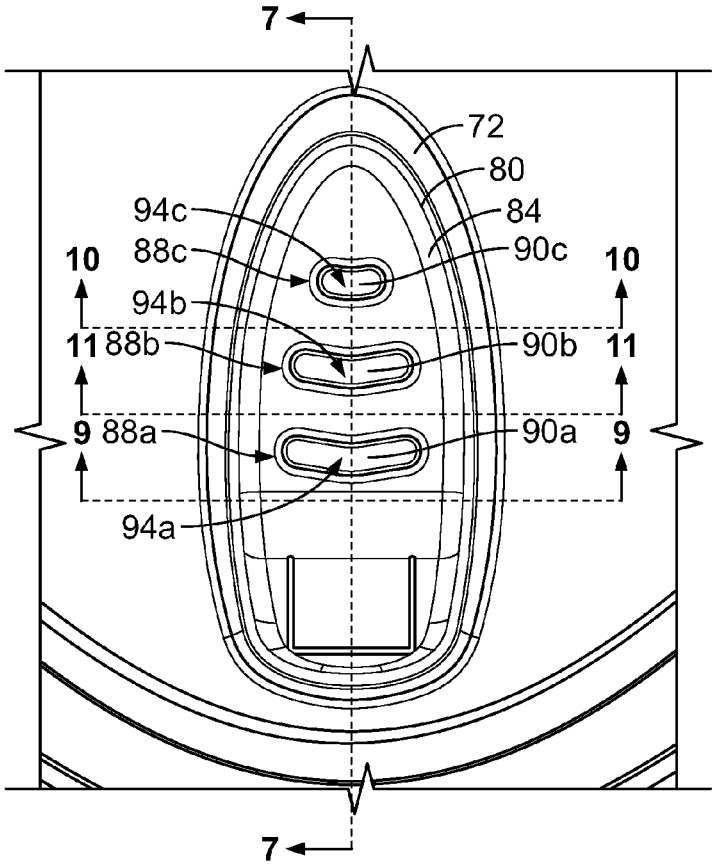
FIG. 6 is a top view of the nose of the pool cleaner of the present disclosure.

Turning to FIGS. 4 and 6, the top surface 74 also includes a plurality of filters 88. The embodiment shown in the drawings of the present application depict three filters, however, any suitable number of filters can be used to accomplish the objectives of the present application. The plurality of filters 88 include a bottom filter wall 90, a downward filter wall 92 (only shown in FIG. 3), and a conduit gap 94. The bottom filter wall 90 and downward filter wall 92 prevent debris from entering the nose water chamber 78. Furthermore, the size of the conduit gap 94 can be relatively small so as to also prevent debris from entering the nose water chamber 78.

Figure 7:
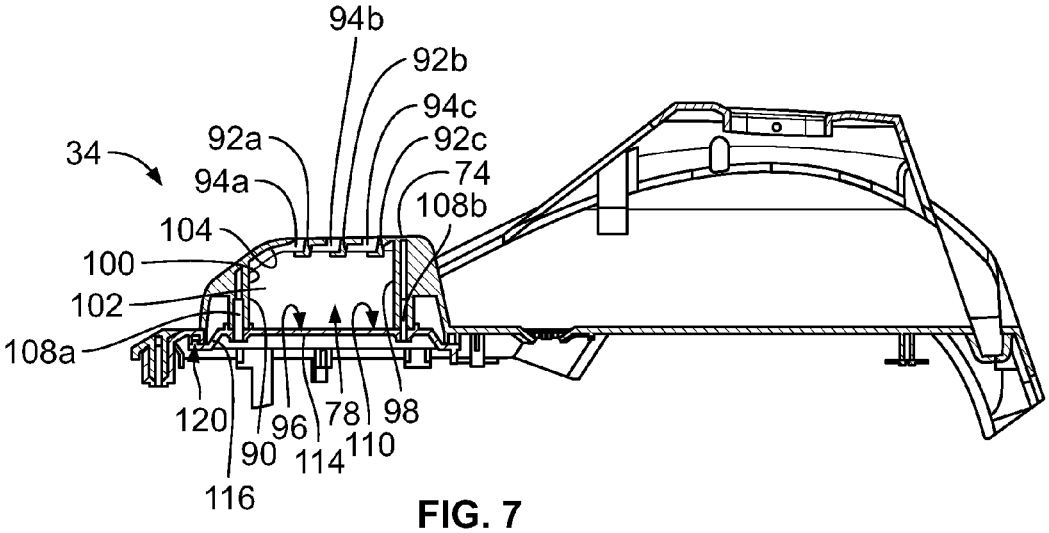
FIG. 7 is a partial cross-sectional view of the pool cleaner of the present disclosure taken along line 7-7 of FIG. 6.

Referring now to FIG. 7, the nose 34 includes a nose water chamber 78, which is formed by the exterior surface 72 and the top surface 74. The nose water chamber 78 includes an interior bottom wall 96, an interior rear wall 98, an interior front wall 100, interior side walls 102, and an interior top wall 104. These components form a water nose chamber 78 in the nose 34 for holding water therein. The nose 34 is preferably located toward the front portion of the pool cleaner 10. While the pool cleaner 10 is in "top" mode, and the nose water chamber 78 has fluid inside, the nose 34 will exert a force on the front portion of the pool cleaner 10, thus keeping the pool cleaner 10 from oscillating vertically.

Turning now to FIG. 8, the nose cover plate 36 includes a top surface 110, a bottom surface 114 which opposes the top surface 110, a sloped surface 116 and an outer surface 118. Top surface 110 can be any suitable shape similar to the shape of the nose 34 and in particular the bottom edge 76 so that the nose cover plate 36 and nose 34 can form a nose water chamber 78 which retains fluid therein. Top surface 110 extends to the sloped surface 116 which extends downward to the outer surface 118. The outer surface 118 extends in an annular fashion similar to the shape of the bottom edge 76. The outer surface 118 includes a protrusion 120, which mates with nose cover protrusion 46. The nose cover protrusion 46 extends downward in an annular fashion from the deck 42 and the protrusion 120 also extends in an annular fashion up from the outer surface 118. Nose cover protrusion 46 can be "H" shaped or any suitable shape to facilitate a tight seal and connection with protrusion 120.

Figure 9:
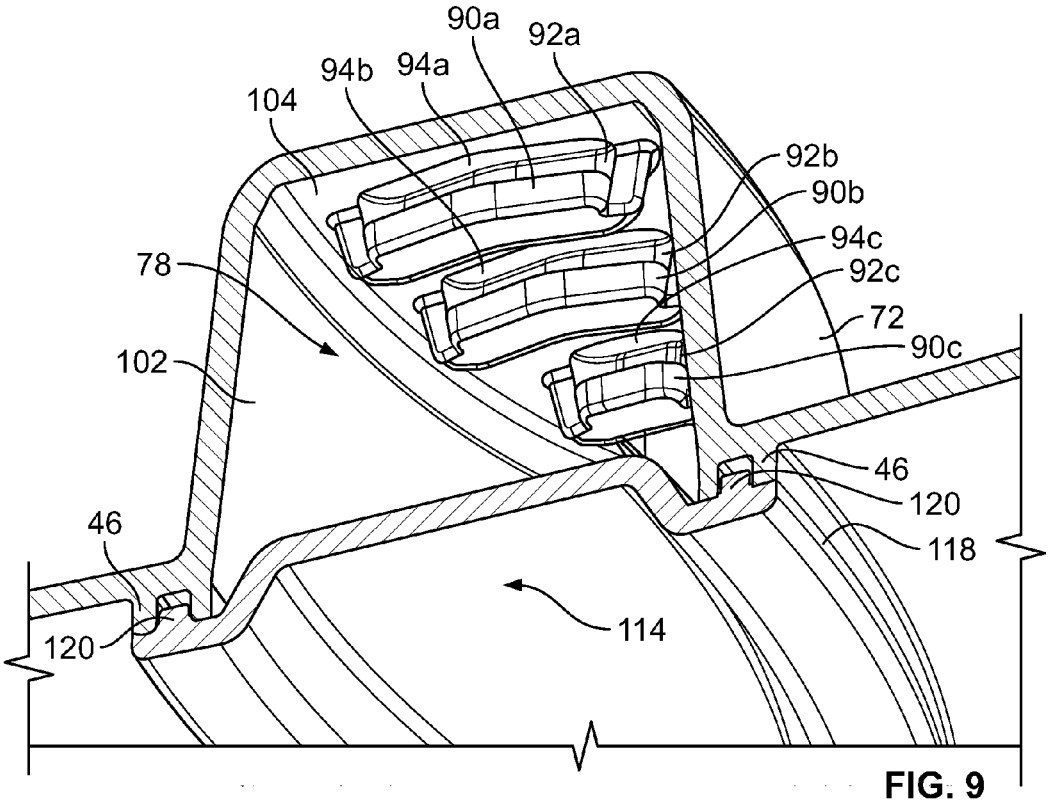
FIG. 9 is a partial cross-sectional view of the pool cleaner of the present disclosure taken along line 9-9 of FIG. 6.

Turning now to FIGS. 9-11, various view of the installation of the nose 34 and the nose cover plate 36 are shown. To facilitate a tight seal between the nose 34 and nose cover plate 36, the nose cover protrusion 46 and protrusion 120 can be similarly shaped. The top surface 110 also includes a plurality of screw apertures 112 (shown in FIG. 8) for receiving a plurality of screws 108 (shown in FIG. 7). The screws 108 would be mounted in the screw boss 79 which can be located within the nose water chamber 78. The plurality of screws 108 further seal and secure nose cover plate 36 to the nose 34 so that fluid is retained within the nose water chamber 78. The nose cover plate 36 can be fastened to the nose 34 in any suitable means known to those of ordinary skill in art, such as by using bonding, adhesives or mechanical fasteners. The invention of the present application is not limited to the use of screws and protrusions as described above. Furthermore, the nose cover plate 36 can be integrally formed with the nose 34 to provide a water tight seal.

FIGS. 9-11 also show the features of the nose water chamber 78 in various views. When the nose cover plate 36 is secured to the nose 34, the nose water chamber 78 is substantially enclosed on all sides, e.g., it is fully enclosed but for filters 88 (and/or an opening, that during top mode, is open to atmosphere but does not permit emptying of the nose chamber, for example). For example, the nose water chamber interior bottom wall 96 is formed by the nose cover plate top surface 110 when the nose cover plate 36 is secured to the nose 34. Furthermore, the interior rear wall 98, interior front wall 100, and the interior side walls 102 are formed by the nose exterior surface 72. Finally, the interior top wall 104 is formed by the nose top surface 74.

The nose 34 can allow fluid to enter the nose water chamber 78 while the top-bottom pool cleaner 10 traverses the bottom of swimming pool 12 or when the nose 34 is otherwise submerged under the water line 16. The nose 34 allows fluid to enter the nose water chamber 78 through the plurality of filters 88 and more specifically through the plurality of conduit gaps 94.

When the top-bottom pool cleaner 10 switches to "top" mode and moves to the surface of the water to clean debris located at the water surface, the nose 34 can retain the fluid that entered the nose 34 while the pool cleaner 10 was in "bottom" mode. The nose 34 retains the fluid by having a nose water chamber 78 that is substantially enclosed on all sides. In the embodiment of cleaner 10 shown, essentially the only place for fluid to exit the nose water chamber 78 is through the plurality of conduit gaps 94 located on the top surface 74 of the nose 34. Although some fluid may inevitably splash out through the plurality of conduit gaps 94, the force of gravity will prevent most of the fluid from exiting the nose 34. Furthermore, the bottom filter wall 90 and the downward filter wall 92 will also help keep fluid within the nose water chamber 78 by preventing splashing of the water when the pool cleaner 10 is in motion.

As discussed above, when the pool cleaner 10 switches to "top" mode and reaches the water surface, the pool cleaner 10 in the prior art would typically oscillate vertically causing the front portion of the pool cleaner 10 to periodically angle above and below the surface water, and prevent the pool cleaner 10 from effectively skimming the pool water line 16 for debris. The benefit of having the nose 34 retain water within the nose water chamber 78 is that when the pool cleaner 10 is in "top" mode and the nose 34 emerges from the pool water line 16, the nose 34 will exert a downward force on the front portion of the pool cleaner 10. This force will dampen the oscillation of the pool cleaner 10 when it reaches the pool water line 16 in "top" mode. In particular, the nose 34 will keep the front portion of the pool cleaner 10 substantially at or near a zero degree angle relative to the pool water line 16 and prevent, e.g., inhibit, the cleaner 10 from oscillating in a upward positive angle relative to the pool water line 16. By forcing the pool cleaner to stay substantially at or near a zero degree angle relative to the pool water line 16, debris located at the pool water line 16 can be directed through the deck 42, skimmer opening 56, channel 58 and into the debris bag 62.

It should be noted that the force generated by the nose 34 is directly proportional to the amount of the nose 34 that is above the water surface. As more of the nose 34 emerges from the water surface, the greater the downward force generated on the front portion of the cleaner 10. Therefore, exterior surface 72 should be of sufficient height to allow nose 34 to be above the pool water line 16 while the cleaner 10 is in top mode. As noted above, while the nose 34 is fully submerged, there is no force generated by the water in the nose water chamber 78.

As discussed with reference to the prior art of FIG. 12, an issue with the prior art is that a pressure wave 8 is created in the front of the cleaner 10 directing debris along lines A away from the cleaner 10 while cleaner 10 is in "top" mode skimming the water surface for debris.

Figure 13:
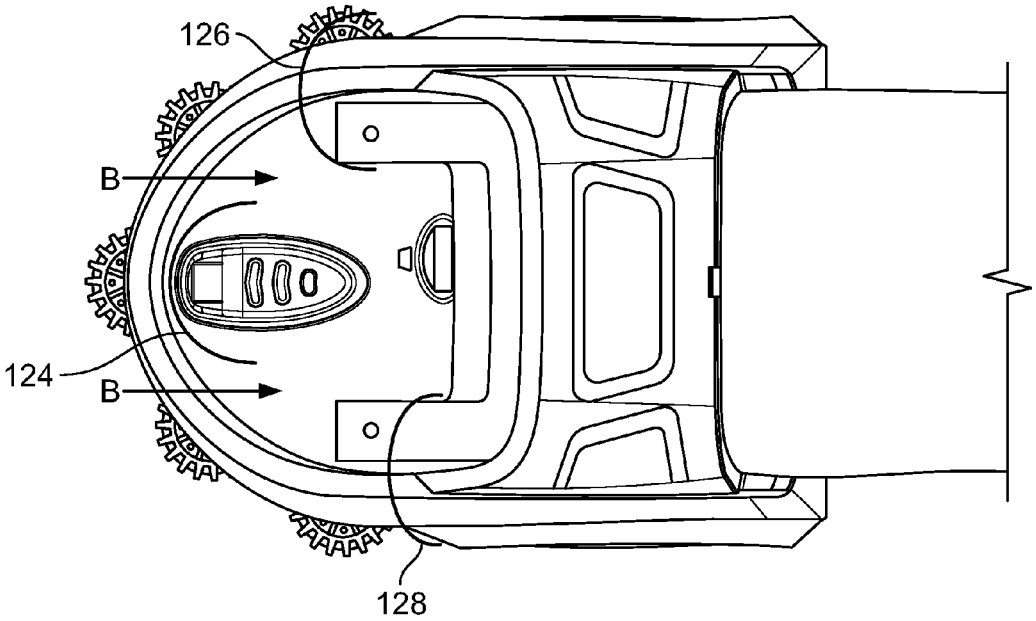
FIG. 13 is a top view of the pool cleaner of the present disclosure.

However, as shown in the present disclosure of FIG. 13, providing a nose, such as the nose 34, with the cleaner 10 solves a problem in the prior art because the presence of the nose 34 creates a first pressure wave 124, second pressure wave 126 and third pressure wave 128. These pressure waves direct debris along lines B toward the skimmer opening 56 and directly through channel 58 and into the debris bag 62. In some embodiments, as an alternative to having a nose 34 fill-up with water to engender advantageous oscillation dampening and pressure waves, the nose can be fabricated as a solid material having a substantially similar density to water, such as a solid ABS plastic material.

Having thus described the invention in detail, it is to be understood that the foregoing description is not intended to limit the spirit or scope thereof. It will be understood that the embodiments of the present invention described herein are merely exemplary and that a person skilled in the art may make any variations and modification without departing from the spirit and scope of the invention. All such variations and modifications, including those discussed above, are intended to be included within the scope of the invention.

What is claimed is:

1. A top-bottom pool cleaner comprising:

a top housing; and a nose attached to the top housing and including an exterior surface and a top surface having a filter, the nose defining a chamber for receiving and retaining water within the nose;

wherein the chamber of the nose receives water through the filter when the cleaner is submerged and retains water within the chamber when the cleaner reaches a top surface of the water from under the water surface.

2. The top-bottom pool cleaner of claim 1, comprising a nose cover plate for securing the nose to the top housing of the cleaner.

3. The top-bottom pool cleaner of claim 2, wherein the nose cover plate further comprises a protrusion and a plurality of screws for securing the nose to the top housing of the cleaner.

4. The top-bottom pool cleaner of claim 3, comprising a screw boss located within the nose for retaining the screws which secure the nose cover plate to the nose.

5. The top-bottom pool cleaner of claim 4, wherein the chamber of the nose, includes a bottom wall formed by a top surface of the nose cover plate.

6. The top-bottom pool cleaner of claim 1, wherein the filter includes a bottom wall and a downward wall to further retain water within the chamber and prevent debris from entering the chamber.

7. The top-bottom pool cleaner of claim 1, wherein the top surface of the nose includes a sloped top portion to allow debris to move past the nose.

8. The top-bottom pool cleaner of claim 7, wherein a front portion of the exterior surface has a height lower than other portions of the exterior surface.

9. The top-bottom pool cleaner of claim 1, comprising a chassis including a first and second rear wheel and a front wheel.

10. The top-bottom pool cleaner of claim 1, wherein the exterior surface includes a first chamfered edge and the top surface includes a second chamfered edge, the first and second chamfered edges abutting one another.

11. A top-bottom pool cleaner for cleaning at least a water surface thereof, comprising:

a top housing; and a nose attached to the top housing and including an exterior surface and a top surface having a filter, the nose defining a chamber for receiving and retaining water within the nose;

wherein the chamber of the nose receives water through the filter when the cleaner is submerged and retains water within the chamber when the cleaner reaches a top surface of the water from under the water surface, the retention of the water within the nose inhibiting oscillation of the pool cleaner above and below the water surface.

12. The top-bottom pool cleaner of claim 11, comprising a nose cover plate for securing the nose to the top housing of the cleaner.

13. The top-bottom pool cleaner of claim 12, wherein the nose cover plate comprises a protrusion and a plurality of screws for securing the nose to the top housing of the cleaner.

14. The top-bottom pool cleaner of claim 13, comprising a screw boss located within the nose for retaining the screws which secure the nose cover plate to the nose.

15. The top-bottom pool cleaner of claim 14, wherein the chamber of the nose includes a bottom wall formed by a top surface of the nose cover plate.

16. The top-bottom pool cleaner of claim 11, wherein the filter includes a bottom wall and a downward wall to further retain water within the chamber and prevent debris from entering the chamber.

17. The top-bottom pool cleaner of claim 11, wherein the top surface of the nose includes a sloped top portion to allow debris to move past the nose.

18. The top-bottom pool cleaner of claim 17, wherein a front portion of the exterior surface has a height lower than other portions of the exterior surface.

19. The top-bottom pool cleaner of claim 11, wherein the exterior surface includes a first chamfered edge and the top surface includes a second chamfered edge, the first and second chamfered edges abutting one another.

20. A top-bottom pool cleaner comprising:

a top housing; and a nose attached to the top housing and including an exterior surface and a top surface having a filter, the nose defining a chamber for receiving and retaining water within the nose;

wherein the chamber of the nose receives water through the filter when the cleaner is submerged and retains water within the chamber when the cleaner reaches a top surface of the water from under the water surface, the nose defining first and second pressure waves, the first and second pressure waves directing debris past the nose of the pool cleaner.

* * * * *